US008355655B2

(12) United States Patent
Sakamaki

(10) Patent No.: US 8,355,655 B2
(45) Date of Patent: Jan. 15, 2013

(54) DEVELOPMENT APPARATUS

(75) Inventor: Tomoyuki Sakamaki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 350 days.

(21) Appl. No.: 12/869,008

(22) Filed: Aug. 26, 2010

(65) Prior Publication Data

US 2011/0052233 A1 Mar. 3, 2011

(30) Foreign Application Priority Data

Sep. 2, 2009 (JP) ..... 2009-202405

(51) Int. Cl.
*G03G 15/08* (2006.01)

(52) U.S. Cl. ..... 399/254; 399/53

(58) Field of Classification Search ..... 399/254–256, 399/258, 53

See application file for complete search history.

(56) References Cited

U.S. PATENT DOCUMENTS

| | | | | |
|---|---|---|---|---|
| 5,839,021 | A * | 11/1998 | Hayashi et al. | |
| 6,033,818 | A | 3/2000 | Sugiyama et al. | |
| 6,122,472 | A | 9/2000 | Sako et al. | |
| 6,973,281 | B2 | 12/2005 | Hirobe et al. | |
| 7,099,609 | B2 | 8/2006 | Hirobe et al. | |
| 7,231,154 | B2 | 6/2007 | Sakamaki | |
| 7,260,348 | B2 * | 8/2007 | Matsuzaki | |
| 7,561,838 | B2 | 7/2009 | Sakamaki et al. | |
| 7,653,336 | B2 | 1/2010 | Akashi et al. | |
| 7,668,490 | B2 * | 2/2010 | Endo et al. | |
| 7,725,061 | B2 | 5/2010 | Sakamaki et al. | |
| 2006/0222404 | A1 | 10/2006 | Watanabe et al. | |
| 2007/0231015 | A1 | 10/2007 | Sakamaki | |
| 2007/0237535 | A1 | 10/2007 | Yoshioka et al. | |
| 2010/0028053 | A1 * | 2/2010 | Kasai | 399/255 |
| 2010/0061773 | A1 | 3/2010 | Akashi et al. | |

FOREIGN PATENT DOCUMENTS

| | | | |
|---|---|---|---|
| JP | 5-35067 | A | 2/1993 |
| JP | 5-333691 | A | 12/1993 |
| JP | 2000-98734 | A | 4/2000 |
| JP | 2001-350340 | A | 12/2001 |
| JP | 2003-263025 | A | 9/2003 |
| JP | 2005-010558 | A | 1/2005 |
| JP | 2005-010562 | A | 1/2005 |

(Continued)

OTHER PUBLICATIONS

Official Action dated Nov. 7, 2011, in Russian Application No. 2010136743/28(052184).

(Continued)

*Primary Examiner* — Susan Lee

(74) *Attorney, Agent, or Firm* — Fitzpatrick, Cella, Harper & Scinto

(57) ABSTRACT

In a development apparatus including conveying screws which circulates and conveys developer in a developer container as being rotated, a developing sleeve which bears and conveys developer in the developer container as being rotated, and a restriction blade which restricts developer quantity at the developing sleeve, the developer container includes a supply chamber to supply developer to the developing sleeve and a retrieval chamber to retrieve developer from the developing sleeve, and rotation speed of the conveying screws or rotation speed of the developing sleeve is changed so that Vsc/Vsl during image forming is not performed is to be smaller than that during image forming is performed, as Vsc denotes the rotation speed of the conveying screws and Vsl denotes the rotation speed of the developing sleeve.

6 Claims, 12 Drawing Sheets

FOREIGN PATENT DOCUMENTS

| | | | |
|---|---|---|---|
| JP | 2005-92061 | A | 4/2005 |
| JP | 2006-58504 | A | 3/2006 |
| JP | 2006-337587 | A | 12/2006 |
| JP | 2007-79489 | A | 3/2007 |
| JP | 3989422 | B2 | 10/2007 |
| JP | 2007-333819 | A | 12/2007 |
| JP | 2009-53426 | A | 3/2009 |
| JP | 2009-92911 | A | 4/2009 |
| JP | 2009-202405 | A | 9/2009 |
| JP | 2009271415 | A * | 11/2009 |
| JP | 2010-48859 | A | 3/2010 |

OTHER PUBLICATIONS

Notification of the First Office Action dated May 9, 2012, in Chinese Application No. 201010268900.6.

Notice of Reasons for Refusal dated Aug. 23, 2011, in Japanese Application No. 2009-202405.

* cited by examiner

DEVELOPMENT APPARATUS

BACKGROUND OF THE INVENTION

1. Field of the Invention

The present invention relates to a development apparatus in an image forming apparatus which visualizes an electrostatic latent image formed on an image bearing member with developer including toner in an electrophotographic system or an electrostatic recording system, in particular, related to a development apparatus mounted on an image forming apparatus.

2. Description of the Related Art

Conventionally, in an image forming apparatus utilizing an electrophotographic system, an electrostatic latent image formed on a photosensitive member as an image bearing member is visualized as a toner image with toner in developer by utilizing a development apparatus.

The most popular development apparatus is constituted with a developer container to accommodate developer, a conveying member to convey developer in the developer container while agitating and mixing, a developer bearing member to bear and convey developer to an opposed part of a photosensitive member, and a thickness restriction member to restrict developer quantity at the developer bearing member.

Here, the development apparatus utilizing dual-component developer containing nonmagnetic toner and magnetic carriers, for example, is described. The developer accommodated in the developer container is agitated and mixed by a conveying screw as a conveying member within the developer container. The developer is charged with frictional electrification during the process of the agitating and mixing. The charged developer is borne mainly with magnetic force at a developing sleeve as the developer bearing member having a magnet as magnetic field generating unit arranged at the inside thereof. The developing sleeve is rotatably arranged at a position opposed to the photosensitive member. The developer is conveyed to a developing area being the opposed part of the photosensitive member according to rotation of the developing sleeve and used for developing. In the developing area, the toner in the developer is transferred to an electrostatic latent image formed on a surface of the photosensitive member with developing bias applied to the developing sleeve, so that a toner image corresponding to the electrostatic latent image is formed on the surface of the photosensitive member.

In such a development apparatus, a restriction blade as the thickness restriction member is generally arranged so as to be opposed to a circumferential surface of the developing sleeve via a predetermined gap. As the restriction blade, various proposals such as a magnetic plate, a nonmagnetic plate, a combination thereof, and an elastic member are performed and actualized as well. When the developer borne at the developing sleeve is conveyed to the developing area, the quantity of the developer conveyed to the developing area is adjusted to be restricted during a process of passing through a gap between the developing sleeve and the restriction blade, so that stable quantity thereof is supplied.

With the development apparatus performing the thickness restriction of developer borne at the developing sleeve surface by the restriction blade, there may be a case that following problems occur.

FIG. 12 is a sectional view schematically illustrating a state of dual-component developer at the upstream side of the restriction blade position when utilizing dual-component developer known from the past. The developer gathered up to the surface of a developing sleeve 128 is borne at a surface of the developing sleeve 128, and then, conveyed to the vicinity of the upstream side in the developer conveying direction of the restriction blade position. The developer conveyed to the vicinity of the upstream side of the restriction blade 130 is accumulated once, and then, a part of the developer passes and is conveyed to the developing area having the thickness thereof restricted at the position of the gap between an edge of the restriction blade 130 and the surface of the developing sleeve 128. Meanwhile, the remaining developer which cannot pass through the gap is accumulated at the next upstream part of the restriction blade 130 and composes a developer non-flowing layer. In this manner, a developer flowing layer being conveyed corresponding to the rotation of the developing sleeve 128 and the developer non-flowing layer banked by the restriction blade 130 are formed at the upstream position of the restriction blade 130.

When the developer flowing layer and the developer non-flowing layer are formed as described above, the developer flowing layer rubs with the developer non-flowing layer at the boundary surface thereof. Consequently, in the case of the dual-component developer, toner is separated from carriers. Then, the separated toner is to be in a fixation-like state at the boundary surface due to friction heat by rubbing, so that a toner layer is formed. Such a toner layer grows with lasting usage and interferes with the gap between the restriction blade 130 and the developing sleeve 128. Accordingly, the quantity of developer passing through the gap is decreased. Consequently, the developer quantity conveyed to the developing area fluctuates and a problem such as darkness fluctuation occurs.

As countermeasures against the above problem, it is effective for resolving the problem to decrease developer quantity supplied to the restriction blade and lessen the developer non-flowing layer as reducing accumulation at the restriction blade as less as possible. However, when quantity of the developer supplied to the restriction blade is decreased, there is apt to arise a new problem that quantity of the developer passing through the gap becomes unstable. Therefore, a certain lump quantity of developer is required to exist at the upstream side of the restriction blade. Accordingly, it is difficult to completely eliminate occurrence of the developer non-flowing layer.

In Japanese Patent Laid-Open No. 5-035067, it has been proposed to arrange, at the next upstream side of the restriction blade, a cylinder-shaped toner conveying member which constantly rotates having a consistently constant gap with a developing sleeve in order to prevent forming of the developer non-flowing layer.

In Japanese Patent Laid-Open No. 5-035067, it is described that occurrence of the developer non flowing layer can be prevented. However, bearings to support the toner conveying member and drive unit are required, so that structure complication and cost increase are unavoidable. Further, since the toner conveying member is driven in the opposite direction at a position opposed to the developer bearing member, there may be a risk that developer rapidly deteriorates since strong stress is to be applied to the developer. In addition, in the case of high-speed rotation, there may be a risk that developer is melted and fixed due to generation of heat.

In Japanese Patent Laid-Open No. 2005-092061, a configuration to suppress forming of the developer non-flowing layer into a slight area by arranging a developer accumulation restriction member at a position where the developer non-flowing layer is apt to be formed as developer is accumulated.

However, in Japanese Patent Laid-Open No. 2005-092061, there may be a risk that a toner layer is formed against the developer flowing layer during lasting long usage and starts to disturb developer flowing when the developer non-flowing layer is formed even in the slight area.

SUMMARY OF THE INVENTION

The present invention has been made in views of the above problems and the present invention provides a development apparatus capable of stably maintaining thickness of developer conveyed to a developing area for the long term while eliminating a tone layer from the next upstream part of a restriction blade before the toner layer grows.

According to the present invention, there is provided a development apparatus including: a developer bearing member which bears and conveys developer; a thickness restriction member which restricts developer quantity at the developer bearing member; a first chamber which can accommodate developer which is to be to supplied to the developer bearing member, wherein the first chamber comprises an opening portion to which a part of the developer bearing member is exposed; a second chamber which forms a circulation passage along with the first chamber and which retrieves developer used for development at the developer bearing member; a conveying member which conveys developer in the circulation passage formed by the first chamber and the second chamber; and a controller which is capable of controlling rotation speed of the conveying member and rotation speed of the developer bearing member so that a ratio Vsc/Vsl in a first mode is less than a ratio Vsc/Vsl in a second mode, wherein Vsc denotes the rotation speed of the conveying member and Vsl denotes the rotation speed of the developer bearing member.

Further features of the present invention will become apparent from the following description of exemplary embodiments with reference to the attached drawings.

DESCRIPTION OF THE EMBODIMENTS

In the following, exemplary embodiments of the present invention will be described in detail in an exemplified manner with reference to the drawings. Here, dimensions, materials, shapes and relative arrangement of the structural components described in the following embodiments are to be appropriately changed according to a configuration adopted to the present invention and various conditions. Accordingly, unless otherwise specified, the embodiments are not to be understood to limit the present invention thereto.

First Embodiment

Figure 1:
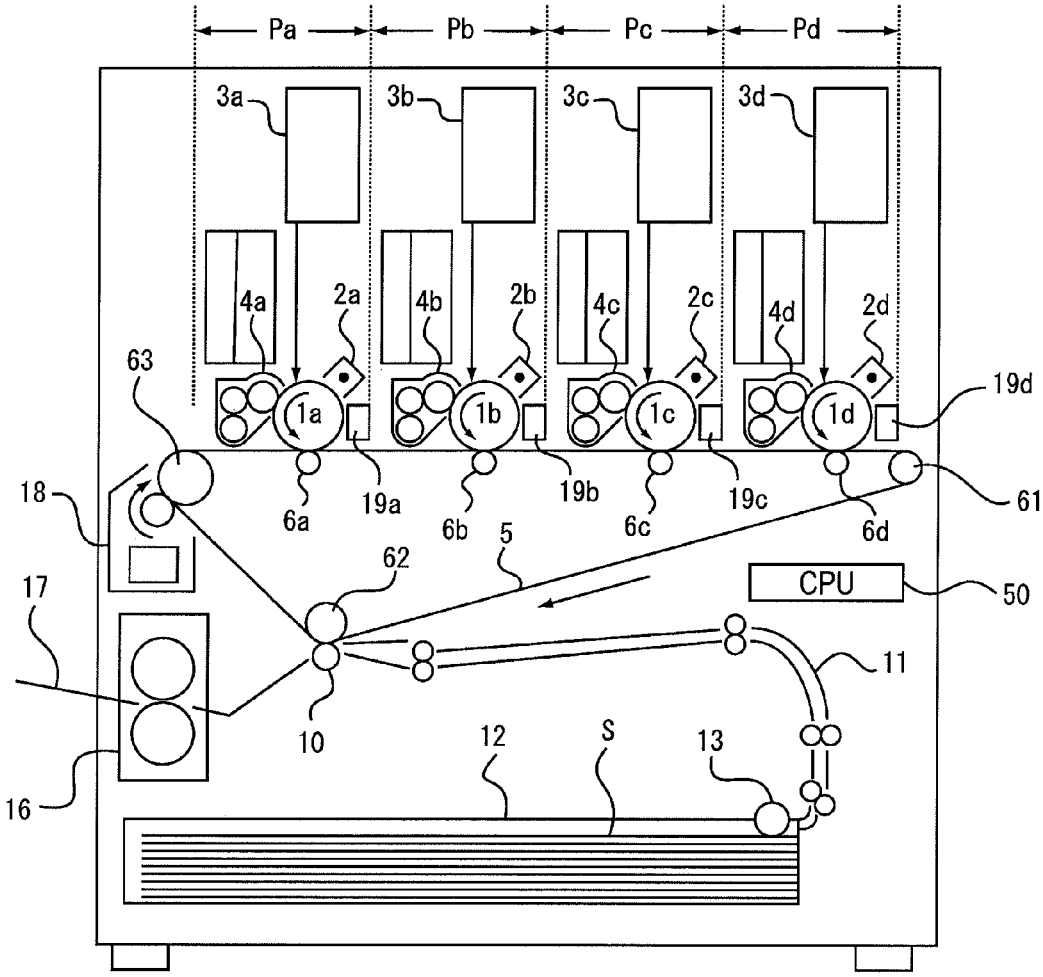
FIG. 1 is a schematic structural explanatory view of an image forming apparatus of the first embodiment.

A general configuration of an image forming apparatus including a development apparatus will be described with reference to FIG. 1. FIG. 1 is a schematic sectional view illustrating the general configuration of a full-color image forming apparatus which adopts an electrophotographic system being an embodiment of an image forming apparatus.

As illustrated in FIG. 1, the image forming apparatus includes four image forming portions P (Pa, Pb, Pc, Pd) as image forming units. Each of the image forming portions Pa to Pd includes a drum-shaped electrophotographic photosensitive member, that is, a photosensitive drum 1 (1*a*, 1*b*, 1*c*, 1*d*), being rotated in the direction of the arrow (i.e., the counterclockwise direction) as an image bearing member. A charger 2 (2*a*, 2*b*, 2*c*, 2*d*), a development apparatus 4 (4*a*, 4*b*, 4*c*, 4*d*) and a cleaning device 19 (19*a*, 19*b*, 19*c*, 19*d*) are arranged around each photosensitive drum respectively as process unit. In addition, a laser beam scanner 3 (3*a*, 3*b*, 3*c*, 3*d*) and a transfer roller 6 (6*a*, 6*b*, 6*c*, 6*d*) are arranged, so that the image forming unit is constituted therewith.

The respective image forming portions Pa, Pb, Pc, Pd are configured similarly. Structural members such as the photosensitive drum arranged at the respective image forming portions Pa, Pb, Pc, Pd are configured similarly, as well. Here, the photosensitive drums 1*a*, 1*b*, 1*c*, 1*d* are collectively called "the photosensitive drum 1". Similarly, the chargers 2*a*, 2*b*, 2*c*, 2*d* are collectively called "the charger 2". The laser beam scanners 3*a*, 3*b*, 3*c*, 3*d* are collectively called "the laser beam scanner 3". The development apparatuses 4*a*, 4*b*, 4*c*, 4*d* are collectively called "the development apparatus 4". The transfer rollers 6*a*, 6*b*, 6*c*, 6*d* are collectively called "the transfer roller 6". The cleaning devices 19*a*, 19*b*, 19*c*, 19*d* are collectively called "the cleaning device 19".

Next, image forming sequence of the entire image forming apparatus of the above configuration will be described.

First, the photosensitive drum 1 is evenly charged by the charger 2. The photosensitive drum 1 is rotated in the counterclockwise direction as illustrated by the arrow at predetermined process speed (i.e., circumferential speed, for example, 273 mm/sec). Next, the laser beam scanner 3 performs scanning exposure with laser light modulated with an image signal on the evenly charged photosensitive drum 1. The laser beam scanner 3 incorporates a semiconductor laser. The semiconductor laser outputs laser light as being controlled corresponding to an original image information signal which is output from an original reading device having a photoelectric conversion element such as CCD. Accordingly, surface potential of the photosensitive drum 1 charged by the charger 2 is varied at an image part, so that an electrostatic latent image is formed on the photosensitive drum 1. The electrostatic latent image is to be a visible image, that is, a toner image, as being reversely developed by the development apparatus 4.

In the present embodiment, the development apparatus 4 adopts a dual-component contacting development type utilizing developer containing toner and carriers mixed as developer. However, effects of the present invention can be obtained even with a single-component development type utilizing only toner as developer or a non-contact development type.

By performing the above processes for each image forming portion Pa, Pb, Pc, Pd, toner images of four colors of yellow, magenta, cyan and black are formed respectively on each photosensitive drum 1*a*, 1*b*, 1*c*, 1*d*.

In the present embodiment, an intermediate transfer belt 5 is arranged as an intermediate transfer member below the respective image forming portions Pa, Pb, Pc, Pd. The intermediate transfer belt 5 is suspended by rollers 61, 62, 63 as suspension members so as to be movable in the direction of the arrow.

The toner image on the photosensitive drum 1 (1*a*, 1*b*, 1*c*, 1*d*) is once transferred to the intermediate transfer belt 5 by the transfer roller 6 (6*a*, 6*b*, 6*c*, 6*d*) as primary transfer unit. Accordingly, the toner images of four colors of yellow, magenta, cyan and black are superimposed on the intermediate transfer belt 5, so that a full-color image is formed. The toner remained on the photosensitive drum 1 without being transferred is retrieved to the cleaning device 19.

The full-color image on the intermediate transfer belt 5 is transferred by the action of a secondary transfer roller 10 as a secondary transfer unit to a recording medium S such as a sheet conveyed from a sheet cassette 12 via a sheet feeding roller 13 and a sheet feeding guide 11. The toner remaining on a surface of the intermediate transfer belt 5 without being transferred is retrieved to an intermediate transfer belt cleaning device 18.

Meanwhile, the recording medium S having the toner image transferred is conveyed to a fixing device (a heat roller fixing device) 16 so that image fixing is performed. Then, the recording medium S is discharged to a discharge tray 17.

In the present embodiment, the photosensitive drum 1 of a commonly-used drum-shaped organic photosensitive member is utilized as the image bearing member. However, it is naturally possible to utilize an inorganic photosensitive member such as an amorphous silicon photosensitive member, as well. Further, it is also possible to utilize a belt-shaped photosensitive member.

Here, methods of charging, developing, transferring, cleaning and fixing are not limited to the above, as well.

Figure 2A:
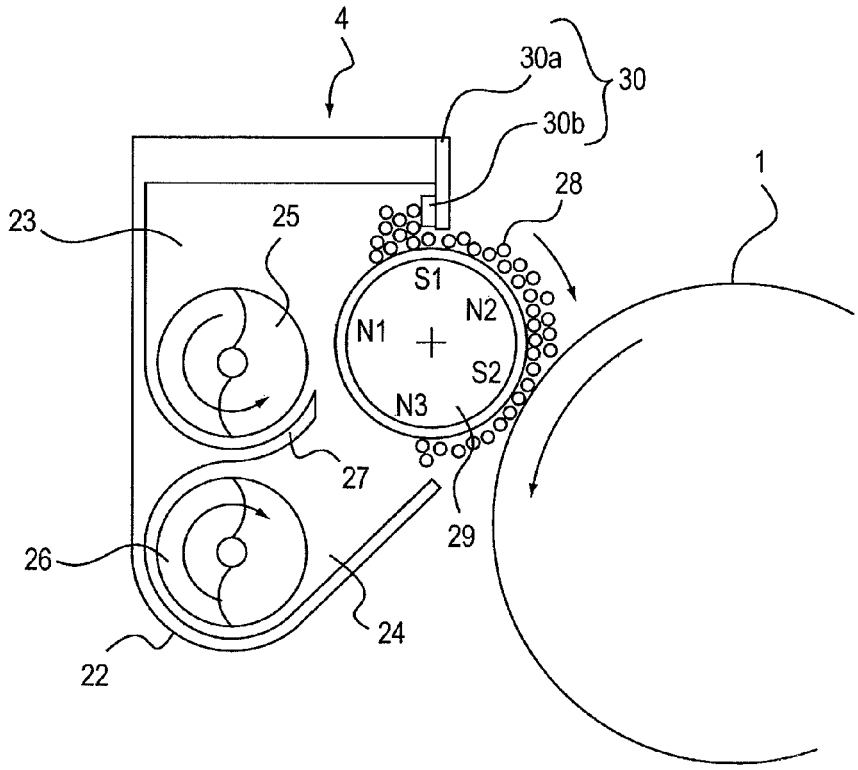
FIGS. 2A and 2B are a structural explanatory view of a development apparatus utilized for the image forming apparatus.
Figure 2B:
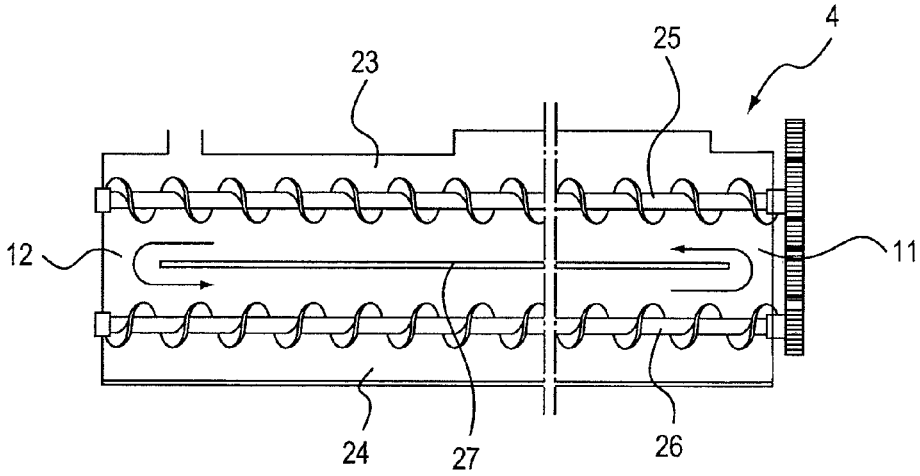

Next, operation of the development apparatus 4 will be described with reference to FIGS. 2A and 2B. FIGS. 2A and 2B are sectional views of the development apparatus 4 according to the present embodiment.

The development apparatus 4 according to the present embodiment includes a developer container 22. Dual-component developer containing toner and carriers are accommodated in the developer container 22 as the developer. Further, a developing sleeve 28 as a developer bearing member and a restriction blade 30 as a thickness restriction member to restrict spikes of developer (i.e., quantity of developer) borne on the developing sleeve 28 are arranged within the developer container 22.

In the present embodiment, the inside of the developer container 22 is compartmented to a supply chamber 23 and a retrieval chamber 24 one above the other at the approximate center thereof by a partition wall 27 extending in the axial direction of the developing sleeve 28. Developer is accommodated in the supply chamber 23 and the retrieval chamber 24. The supply chamber 23 is a developing chamber (i.e., the first chamber) to supply developer to the developing sleeve 28. The retrieval chamber 24 is an agitating chamber (i.e., the second chamber) to retrieve developer from the developing sleeve 28.

First and second conveying screws 25, 26 are arranged respectively at the supply chamber 23 and the retrieval chamber 24 as developer agitating/conveying members. The conveying screws 25, 26 are conveying members which circulate and convey developer in the developer container 22 by being rotated. The first conveying screw 25 is arranged at a bottom part of the supply chamber 23 along the axial direction of the developing sleeve 28 as being approximately parallel thereto. The first conveying screw 25 as the first conveying member conveys developer within the supply chamber 23 in one direction along the axial direction as being rotated in the direction of the arrow in FIG. 2A (i.e., the counterclockwise direction). Counterclockwise rotation is adopted because of being advantageous in view of supplying developer to the developing sleeve 28. Further, the second conveying screw 26 is arranged at a bottom part of the retrieval chamber 24 as being approximately parallel to the first conveying screw 25. The second conveying screw 26 as the second conveying member conveys developer within the retrieval chamber 24 in the opposite direction to the first conveying screw 25 by being rotated in the opposite direction to the first conveying screw 25 (i.e., the clockwise direction). In this manner, the developer is circulated between the supply chamber 23 and the retrieval chamber 24 via opening portions (i.e., communicating portions) 11, 12 at both ends of the partition wall 27 due to conveyance by the rotation of the first and second conveying screws 25, 26.

In the present embodiment, the developer container 22 has an opening portion at a position corresponding to a developing area opposed to the photosensitive drum 1. The developing sleeve 28 is rotatably arranged at the opening portion having apart thereof exposed in the direction toward the photosensitive drum 1.

Here, the diameter of the developing sleeve 28 is to be 20 mm. The diameter of the photosensitive drum 1 is to be 80 mm. The distance between the developing sleeve 28 and the photosensitive drum 1 at the closest area is to be approximately 300 μm. The above configuration is determined so that development can be performed in a state that developer conveyed to a developing portion is contacted to the photosensitive drum 1. The developing sleeve 28 is formed of nonmagnetic material such as aluminum and stainless and a magnet roller 29 is arranged therein as magnetic field unit in a state of not being rotated. The magnet roller 29 has a developing magnetic pole S2 arranged being opposed to the photosensitive drum 1 at the developing portion, a magnetic pole S1 arranged being opposed to the restriction blade 30, a magnetic pole N1 arranged between the magnetic poles S1, S2, and magnetic poles N2, N3 arranged respectively opposed to the supply chamber 23 and the retrieval chamber 24.

The developing sleeve 28 is rotated in the direction of the arrow in FIG. 2A (i.e., the clockwise direction) and bears the dual-component developer having thickness restricted with spike-breaking of a magnetic brush by the restriction blade 30, so that the dual-component developer is conveyed to the developing area opposed to the photosensitive drum 1. In this manner, the developing sleeve 28 supplies developer to the electrostatic latent image formed on the photosensitive drum 1 and develops the latent image. At that time, in order to enhance development efficiency, that is, a transfer rate of toner to a latent image, developing bias voltage having direct-current voltage and alternate-current voltage superimposed is applied to the developing sleeve 28 from a power supply. Here, the direct-current voltage is set at −500 V. The alternate-current is set as the peak-to-peak voltage Vpp being 800 V and the frequency f being 12 kHz. However, the direct-current voltage value and the alternate-current voltage waveform are not limited to the above. Generally, in dual-component magnetic brush development type, developing efficiency is enhanced and image quality is improved when alternate-current voltage is applied. However, on the other hand, fog is apt to be generated. In order to prevent fog occurrence, potential difference is arranged between the direct-current voltage applied to the developing sleeve 28 and the charging potential (i.e., white background potential) of the photosensitive drum 1.

At the developing area, the developing sleeve 28 of the development apparatus 4 is moved in the same direction as the movement direction of the photosensitive drum 1 having the circumferential speed ratio of 1.75 against the photosensitive drum 1. The circumferential speed ratio may be set to be in a range from 0 to 3.0, preferably in a range from 0.5 to 2.0. The development efficiency is enhanced as the movement speed ratio becomes large. However, when being too large, problems such as toner splashing and developer deterioration occur. Therefore, it is preferable to set within the above range.

The restriction blade 30 as the spike-breaking member is constituted with a nonmagnetic member 30*a* formed of plate-shaped aluminum extended along the axis line in the longitudinal direction of the developing sleeve 28 and a magnetic member 30*b* formed of steel material. The restriction blade 30 is arranged at the upstream side from the photosensitive drum 1 in the rotational direction of the developing sleeve 28. Then, both toner and carriers of developer pass between the top end portion of the restriction blade 30 and the developing sleeve 28 so as to be conveyed to the developing area. Here, by adjusting clearance (i.e., a gap) of the restriction blade 30 with the surface of the developing sleeve 28, developer quantity conveyed to the developing area is adjusted as restricting spike-breaking quantity of the developer magnetic brush borne on the developing sleeve 28. In the present embodiment, the developer coat quantity per unit area on the developing sleeve 28 is restricted to be 30 mg/cm$^2$ by the restriction blade 30.

The gap between the restriction blade 30 and the developing sleeve 28 is set to be in a range from 200 to 1000 μm, preferably in a range of 300 to 700 μm. In the present embodiment, the gap is set to 500 μm.

Figure 3A:
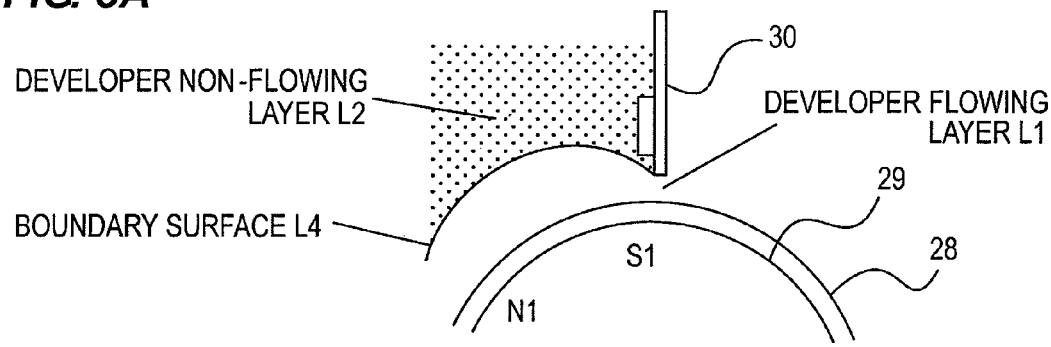
FIG. 3A is an explanatory view of the next upstream part of a restriction blade of the development apparatus.

Next, developer movement at the upstream side of the restriction blade position will be described in detail. FIG. 3A is a simplified sectional view schematically illustrating a state of dual-component developer at the upstream side of the restriction blade position of the present embodiment.

The developer gathered up to the surface of the developing sleeve 28 is borne on the surface of the developing sleeve 28, and then, conveyed to the vicinity of the upstream side in the developer conveying direction of the position of the restriction blade 30. The developer conveyed to the vicinity of the upstream side of the restriction blade 30 is accumulated once, and then, a part of the developer passes and is conveyed to the developing area having the thickness thereof restricted at the position of the gap between the edge of the restriction blade 30 and the surface of the developing sleeve 28. Meanwhile, the remaining developer which cannot pass through the gap between the restriction blade 30 and the developing sleeve 28 composes a developer non-flowing layer as being accumulated at the vicinity of the upstream side of the restriction blade 30. In this manner, a developer flowing layer being conveyed corresponding to the rotation of the developing sleeve 28 and the developer non-flowing layer banked by the restriction blade 30 are formed at the upstream position of the restriction blade 30.

When the developer flowing layer and the developer non-flowing layer are formed as described above, the developer moving layer rubs with the developer non-flowing layer at the boundary surface thereof. Consequently, toner is separated from carriers. Then, the separated toner is to be in a fixation-like state at the boundary surface due to friction heat by rubbing, so that a toner layer is formed. Such a toner layer grows with lasting usage and interferes with the gap between the restriction blade 30 and the developing sleeve 28. Accordingly, the quantity of developer passing through the gap is decreased. Consequently, the developer quantity conveyed to the developing area fluctuates and a problem such as darkness fluctuation occurs.

If the generation of the developer non-flowing layer can be prevented as countermeasures against the above problem, the toner layer is not naturally generated since the boundary surface against which the developer flowing layer should rub does not exist as well. However, in order to stabilize the developer quantity on the developing sleeve 28 to some extent, a certain lump quantity of developer is required to exist at the back side (i.e., the upstream side in the developer conveying direction) of the restriction blade 30. In that case, the developer which cannot pass through the gap between the restriction blade 30 and the developing sleeve 28 composes the developer non-flowing layer. Accordingly, it is difficult to completely eliminate occurrence of the developer non-flowing layer.

In the present embodiment, instead of preventing occurrence of the developer non-flowing layer, the above problem is to be suppressed by regularly eliminating the toner layer occurring between the developer flowing layer and the developer non-flowing layer.

Normally, the above problem does not occur simultaneously with the occurrence of the toner layer between the developer flowing layer and the developer non-flowing layer. The above problem occurs only after the toner layer starts to interfere with the gap between the restriction blade 30 and the developing sleeve 28 as being gradually grown during lasting usage. Accordingly, the above problem can be solved by eliminating the toner layer from the next upstream side of the restriction blade 30 before the toner layer grows and starts to interfere with the gap.

Figure 4A:
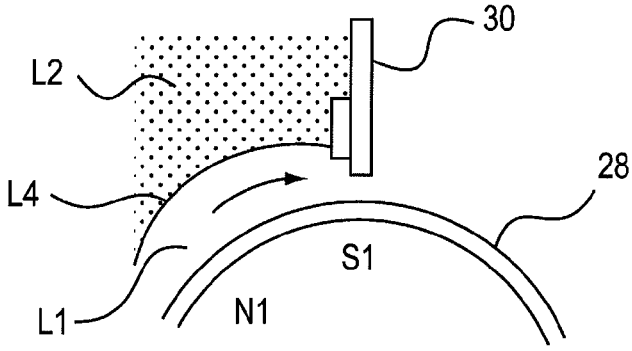
FIGS. 4A to 4D are explanatory views which illustrate operation of the development apparatus.
Figure 4B:
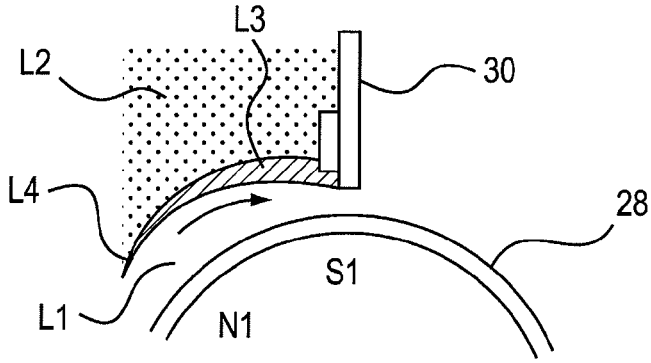
Figure 4C:
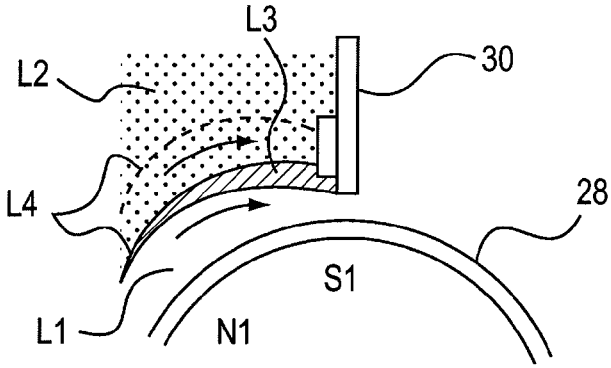
Figure 4D:
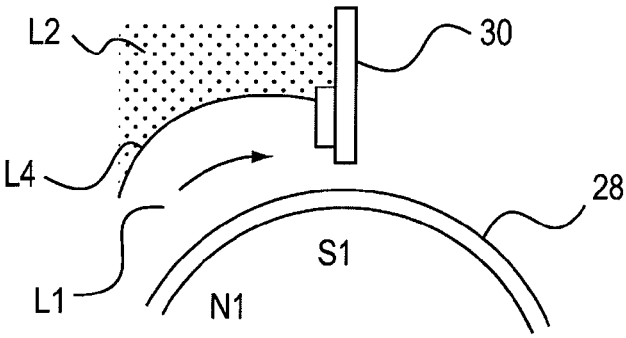

In the present embodiment, the toner layer is eliminated by performing operation to move the boundary surface of the developer flowing layer and the developer non-flowing layer in the direction being apart from the developing sleeve 28. In the following, the description will be performed with reference to FIGS. 4A to 4C. When the developing sleeve 28 and the restriction blade 30 are arranged as illustrated in FIG. 4A, the developer flowing layer L1 and the developer non-flowing layer L2 are formed at the next upstream side of the restriction blade 30, as described above. When usage in such a state is continued, the toner layer L3 is formed at the boundary surface L4 of the developer flowing layer L1 and the developer non-flowing layer L2, as illustrated in FIG. 4B. Then, when usage is further continued, the toner layer L3 grows to be large and starts to disturb conveying of developer to the developing area. Accordingly, the operation to move the boundary surface L4 of the developer flowing layer L1 and the developer non-flowing layer L2 in the direction being apart from the circumferential surface of the developing sleeve 28 is performed before the interference of developer occurs due to growing of the toner layer L3. With this operation, the boundary surface L4 of the developer flowing layer L1 and the developer non-flowing layer L2 is moved from a solid-line position to a dotted-line position as illustrated in FIG. 4C. Accordingly, the previous boundary surface (i.e., the solid-line position) is to be in the developer flowing layer. Then, the toner layer formed at the previous boundary surface is moved to pass the restriction blade 30 along with the developer flowing layer therearound, as illustrated in FIG. 4D. In this manner, the toner layer can be eliminated from the next upstream part of the restriction blade 30.

In the present embodiment, by regularly performing the above operation, the toner layer is eliminated from the next upstream part of the restriction blade 30 before the toner layer starts to disturb conveying of developer to the developing area due to growing of the toner layer.

Next, the method for moving the boundary surface of the developer flowing layer and the developer non-flowing layer in the direction being apart from the circumferential surface of the developing sleeve will be described in detail. First, description will be made how the boundary surface is determined.

In order to move the boundary surface of the developer flowing layer and the developer non-flowing layer, it is important to understand how the boundary surface is determined. According to the study of the inventor, the determination of the boundary surface is well-described by applying a landslide model in geotechnology.

According to the landslide model, the balance between force S to resist against a slide surface (i.e., resistance force) and force T to slide along the slide surface (i.e., slide force) determines whether or not a landslide occurs at a boundary surface (i.e., the slide surface) between a flowing layer and a non-flowing layer. When the ratio S/T between the resistance force S and the slide force T is larger than 1, that is, when the resistance force S is larger than the slide force T, a landslide does not occur. Meanwhile, when the ratio S/T is smaller than 1, that is, when the resistance force S is smaller than the slide force T, a landslide occurs. In view of the above, the surface at which the resistance force S and the slide force T are balanced is to be the slide surface (i.e., the boundary surface between the flowing layer and the non-flowing layer).

Figure 3B:
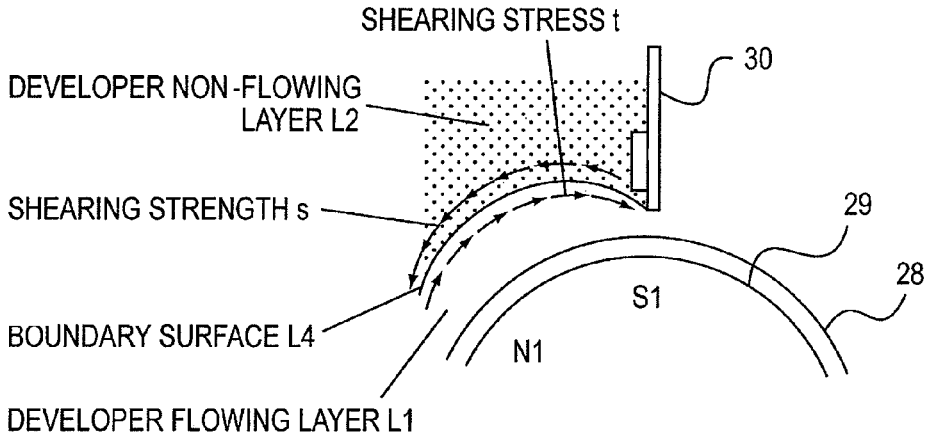
FIG. 3B is an explanatory view of shearing strength s and shearing stress t.

Accordingly, by acquiring resistance force S and slide force T for the developer layer at the next upstream side of the restriction blade, the boundary surface can be predicted to some extent. As illustrated in FIG. 3B, the resistance force S and the slide force T can be acquired by acquiring the maximum value of shearing resistance force (i.e., shearing strength) s and shearing stress t at the slide surface (i.e., the boundary surface L4) as dividing finely and by summing totally. For evaluating determination of the slide surface, the prediction of the slide surface can be rather performed by comparing the shearing strength s and the shearing stress t for each finely divided part.

First, the shearing strength s will be described. In general, the shearing strength s is acquired as $s=c+\mu\sigma$. Here, c denotes adhesive force which increases in proportion to contacting area. The adhesive force c is important when viscous soil is treated. Since developer has characteristics classified to sandy soil rather than viscous soil, the adhesive force c is to be neglected. Then, $\mu\sigma$ denotes force due to friction which increased in proportion to pressing force (i.e., normal stress) $\sigma$. Here, the normal stress $\sigma$ is acquired from the sum of the total weight W (=mg) of the developer existing on the slide surface and magnetic force fm (i.e., the normal component thereof) applied to the developer on the slide surface by the magnet roller 29. In general, a friction coefficient $\mu$ is mentioned as tan $\phi$ and $\phi$ is often called an internal friction angle. The internal friction angle being synonymous with a repose angle when applied to developer in consideration of the definition thereof refers to an angle at which developer is about to start sliding. Further, the developer layer at the next upstream side of the restriction blade 30 receives resistance force fb from the restriction blade 30. Consequently, the shearing strength s is acquired as follows.

$$s=(W+fm)\tan\phi+fb$$

In the above equation, W denotes the weight (kN/m) of the developer applied on the slide surface. Further, as described above, fm denotes the magnetic force (i.e., the normal component thereof) (kN/m) applied to the developer on the slide surface and $\phi$ denotes the inner friction angle of the slide surface (=the repose angle of developer) (°). Further, fb denotes restriction force (kN/m) by the restriction blade applied to the developer on the slide surface.

There may be a case that a developer returning member is arranged to adjust accumulated developer quantity at the next upstream part of the restriction blade. In that case, the above consideration can be performed as adding the force due to the developer returning member to the restriction force fb.

Meanwhile, the shearing stress t is mainly composed of propulsive force fs due to rotation of developing sleeve when applied to the developer layer at the next upstream part of the restriction blade and is acquired as follows.

$$t=fs$$

In the above equation, fs denotes the propulsive force (kN/m) accompanied by the developing sleeve rotation applied to the developer on the slide surface.

Here, the magnetic force applied to the developer on the slide surface has a tangent component. Depending on positions thereof, there may be a case that the tangent component of the magnetic force directs to the rotation direction of the developing sleeve or to the opposite direction thereto. To be exact, the force should be added to the shearing stress t and the shearing strength s. However, since the value thereof is small compared to other force, the force is to be neglected here. Even though being neglected, substance of the present invention remains same.

Based on comparison between the shearing strength s and the shearing stress t of developer acquired as described above, positions having larger shearing strength s are apt to be in the developer non-flowing layer and positions having larger shearing stress t are apt to be in the developer flowing layer. Accordingly, it is understood that positions where the shearing strength s and the shearing stress t are balanced compose the slide surface (i.e., the boundary between the flowing layer and non-flowing layer).

Figure 3C:
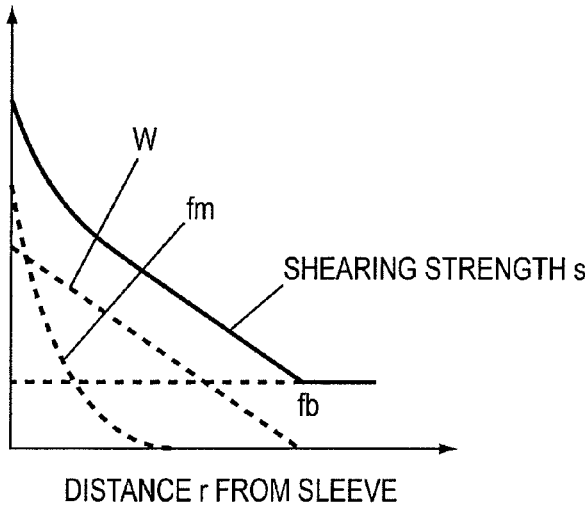
FIG. 3C is a graph which schematically indicates the shearing strength s.

In the following, the shearing strength s and the shearing stress t are compared having the distance r from the developing sleeve as a parameter. First, among the shearing strength s, the developer weight W applied on the slide surface decreases approximately linearly because the developer quantity decreases as the slide surface being apart from the developing sleeve 28. The magnetic force fm decreases approximately in inverse proportion to the square of the distance r as being apart from the developing sleeve 28, that is, as being apart from the accommodated magnet roller 29. The restriction force fb applied to the developer on the slide surface by the restriction blade 30 is mainly dependent on distance from the restriction blade 30 and is not rather dependent on the distance r from the developing sleeve. The above forces are schematically indicated on a graph as illustrated in FIG. 3C. The shearing strength $s=(W+fm)\tan\phi+fb$ to be calculated from the above forces is also indicated in FIG. 3C.

Figure 5A:
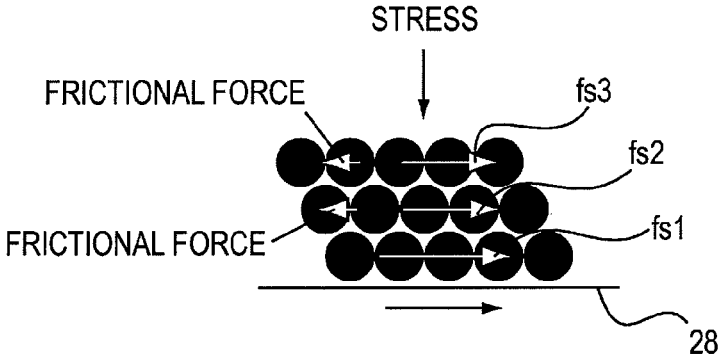
FIG. 5A is an explanatory view which illustrates propulsive force applied from a developing sleeve.
Figure 5B:
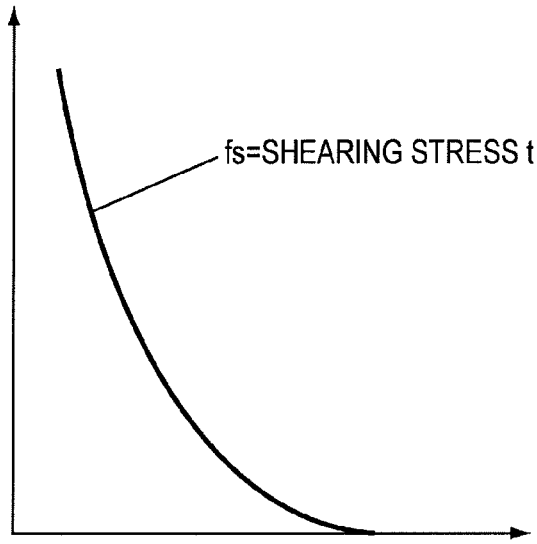
FIG. 5B is a graph which schematically indicates the shearing stress t.

Meanwhile, among the shearing stress t, the propulsive force fs accompanied by the developing sleeve 28 rotation applied to the developer on the slide surface decreases as being apart from the developing sleeve 28. The phenomenon can be understood as follows. Considering a carrier layer of the first layer and a carrier layer of the second layer on the developing sleeve 28 as illustrated in FIG. 5A, when propulsive force fs1 applied to the carrier layer of the first layer from the developing sleeve 28 is transmitted to the second layer, friction force caused by normal stress to the developer layer is exerted. Therefore, the propulsive force fs2 of the second layer is smaller than the propulsive force fs1 of the first layer by the amount of the friction force. Further, the propulsive force fs3 of the third layer is smaller than the propulsive force fs2 by the amount of the friction force. The propulsive force of the fourth layer or upper is similar to the above. Accordingly, the propulsive force fs applied from the developing sleeve 28 to the slide surface decreases according to increase of distance r from the developing sleeve 28. Here, since the magnetic force and the weight of the developer layer to cause the normal stress decreases as being farther from the developing sleeve 28, the friction force is tend to decrease accordingly. Thus, according to increase of the distance r from the developing sleeve 28, the propulsive force fs applied from the developing sleeve 28 decreases as the decreasing amount decreases. Accordingly, the propulsive force fs (i.e., the shearing stress t) accompanied by the rotation of the developing sleeve 28 applied to the developer on the slide surface is schematically indicated on a graph as illustrated in FIG. 5B.

Figure 5C:
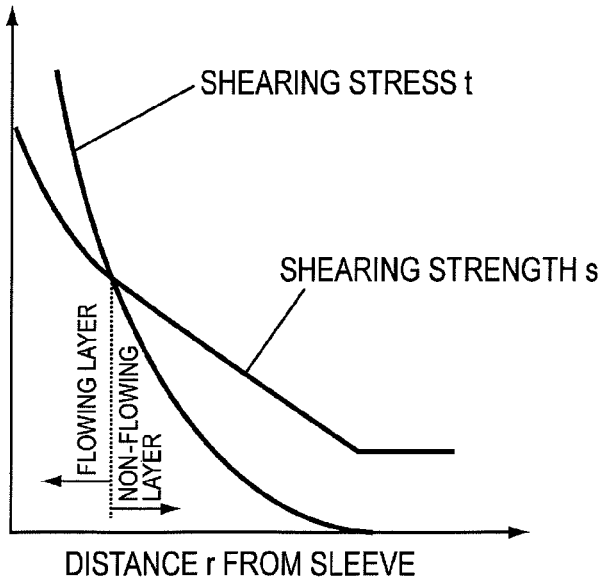
FIG. 5C is an explanatory view for determining boundary surface between a developer flowing layer and a developer non-flowing layer.

As described above, based on comparison between the shearing strength s and the shearing stress t of the developer, positions having larger shearing strength s are apt to be in the developer non-flowing layer and positions having larger shearing stress t are apt to be in the developer flowing layer, and then, positions where the shearing strength s and the shearing stress t are balanced compose the slide surface (i.e., the boundary between the flowing layer and the non-flowing layer). Accordingly, when the shearing strength s and the shearing stress t are simultaneously indicated on a graph as illustrated in FIG. 5C, the intersection of both is to be the slide surface (i.e., the boundary between the flowing layer and the non-flowing layer). Then, based on comparison between the shearing strength s and the shearing stress t, positions having larger shearing strength s are in the non-flowing layer and positions having larger shearing stress t are in the flowing-layer.

The boundary between the flowing layer and the non-flowing layer can be predicted by utilizing the graph of FIG. 5C. Considering as applying to an actual phenomenon, normally, the restriction force fb due to the restriction blade 30 tends to be larger as being closer from the restriction blade 30, for example. Here, when the restriction force fb due to the restriction blade 30 is large, the shearing strength s is to be large as well. Considering with reference to the graph of FIG. 5C, when the shearing strength s is shifted upward, the intersection between the shearing strength s and the shearing stress t is shifted leftward, so that the boundary surface between the flowing layer and the non-flowing layer is predicted to be shifted in the direction being close to the developing sleeve 28. This prediction corresponds to an actually observed phenomenon. According to the study of the inventor, as illustrated in FIG. 3A, it is observed that the boundary surface between the flowing layer and the non-flowing layer is to be close as being close to the restriction blade 30, so that the area of the flowing layer is narrowed.

Figure 6A:
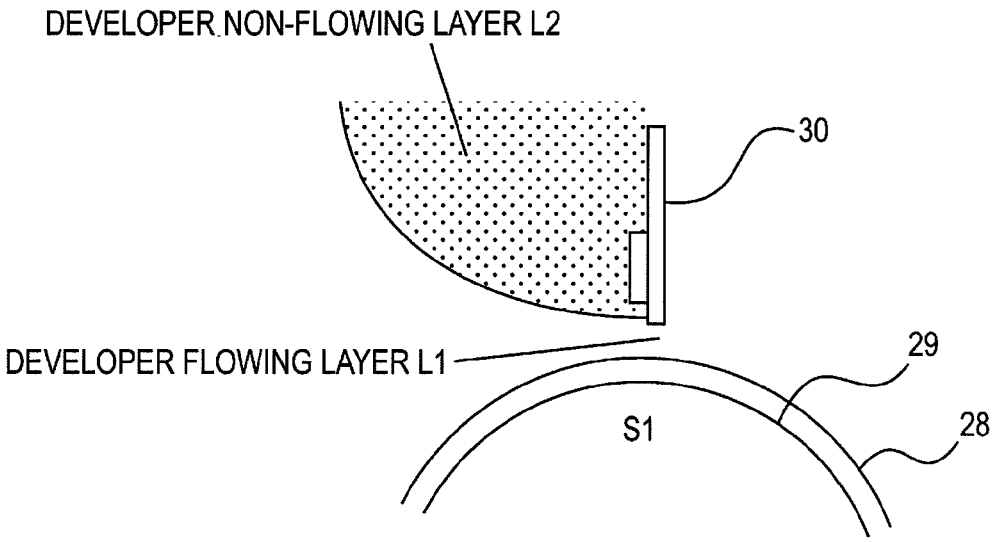
FIG. 6A is an explanatory view for determining the boundary surface between the developer flowing layer and the developer non-flowing layer.

For another example, in the present embodiment, the magnetic pole S1 is arranged opposed to the restriction blade 30 and the magnetic pole N1 opposite thereto is further arranged at the upstream side. Accordingly, roughly approximately constant magnetic force fm is exerted between the magnetic poles S1 and N1 in the direction toward the developing sleeve 28. Since the magnetic force fm does not vary largely between the magnetic poles S1 and N1, the balance between the shearing strength s and the shearing stress t does not vary largely as well. Accordingly, it is predicted that the boundary surface is formed having the distance from the developing sleeve 28 approximately constant as illustrated in FIG. 3A. This prediction approximately corresponds to the study of the inventor. Further, as illustrated in FIG. 6A, in the case that the opposite magnetic pole N1 is not arranged at the upstream side of the magnetic pole S1 opposed to the restriction blade 30, the magnetic force fm becomes small as moving from the magnetic pole S1 to the upstream side of the rotational direction of the developing sleeve 28, so that the shearing strength s becomes small as well. Accordingly, as illustrated in FIG. 6A, it is predicted that the area of the flowing layer increases as moving from the magnetic pole S1 to the upstream side. This prediction also corresponds to the study of the inventor. As illustrated in FIG. 6A, the present invention is effective also in the case that one pole (including a same pole existing further upstream side) is arranged at the upstream side of the restriction blade 30.

As described above, it is understood that the boundary surface between the flowing layer and the non-flowing layer of developer can be predicted by acquiring the shearing strength s and the shearing stress t and evaluating the balance thereof.

In the present embodiment, the operation to move the boundary surface between the developer flowing layer and the developer non-flowing layer in the direction being apart from the circumferential surface of the developing sleeve is regularly performed. In the following, the method for moving the boundary surface in the direction being apart from the sleeve surface will be described based on the model of determining the boundary surface corresponding to the abovementioned balance between the shearing strength s and the shearing stress t.

As described above, when the boundary surface between the developer flowing layer and the developer non-flowing layer is moved in the direction being apart from the surface of the developing sleeve 28, the position of the boundary surface by that time having the toner layer formed is to be in the flowing layer. Accordingly, the toner layer can be eliminated from the next upstream side of the restriction blade 30. Here, the method for moving the boundary surface between the developer flowing layer and the developer non-flowing layer in the direction being apart from the developing sleeve 28 is considered based on the model of determining the boundary surface corresponding to the balance between the shearing strength s and the shearing stress t. Then, it is understood that the shearing strength s is to be smaller than the shearing stress t.

In order to enlarge the shearing strength s, it is only needed to enlarge any one of the weight W of the developer weighting on the slide surface, the magnetic force fm applied to the developer on the slide surface and the restriction force fb by the restriction blade 30 applied to the developer on the slide surface, which determine the shearing strength s. Here, in order to change the magnetic force fm and the restriction force fb, it is required to respectively change structure of the magnet roller 29 in the developing sleeve 28 and structure of the restriction blade 30. To perform the changing in a short time during operation is difficult. Accordingly, the present embodiment adopts a method for changing largeness of the shearing strength s by changing the weight W of the developer weighting on the slide surface. The method for changing the developer weight W will be described later in detail.

Figure 6B:
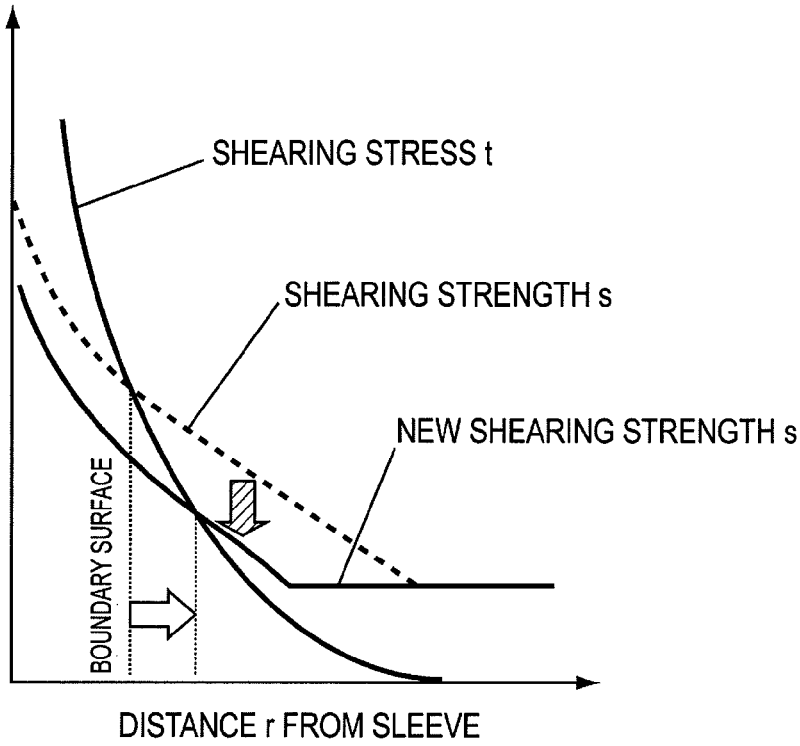
FIG. 6B is an explanatory view for movement of the boundary surface of the first embodiment.

More specifically, changing the developer weight W means that changing the quantity of developer layer at the next upstream part of the restriction blade 30. When the developer layer accumulated at the next upstream part of the restriction blade 30 is lessened, the weight W of the developer weighting on the slide surface is lessened and the shearing strength s is lessened as well. When the shearing strength s is lessened, the intersection between the developer non-flowing layer and the developer flowing layer is shifted rightward as illustrated in FIG. 6B, so that the boundary surface between the developer non-flowing layer and the developer flowing layer can be shifted in the direction of being apart from the circumferential surface of the developing sleeve 28.

In the present embodiment, the rotation speed of the conveying screws 25, 26 is decreased while maintaining the rotation speed of the developing sleeve 28 as a method for lessening the developer layer accumulated at the next upstream part of the restriction blade 30. When the rotation speed of the conveying screws 25, 26 is decreased, the quantity of developer supplied to the developing sleeve 28 due to the rotation of the conveying screws 25, 26 is decreased. Accordingly, the quantity of the developer layer at the next upstream part of the restriction blade 30 is decreased as well.

However, there may be a case that large variation of the developer quantity cannot be obtained only with the above configuration. Therefore, in the present embodiment, the developer container 22 is configured to be divided into the supply chamber 23 for supplying developer to the developing sleeve 28 and the retrieval chamber 24 for retrieving developer from the developing sleeve 28. By configuring to divide the developer container 22 into the supply chamber 23 and the retrieval chamber 24 as described above, the quantity variation of the developer layer at the next upstream part of the restriction blade 30 can be enlarged and accelerated. The reason is as follows.

When the developer container 22 is configured to be divided into the supply chamber 23 and the retrieval chamber 24 as described above, the developer supplied from the supply chamber 23 to the developing sleeve 28 is retrieved to the retrieval chamber 24. The developer retrieved to the retrieval chamber 24 is conveyed to the supply chamber 23 once again due to the rotation of the conveying screws 25, 26 and is to be supplied to the developing sleeve 28. Here, when the rotation speed of the conveying screws 25, 26 is decreased without changing the rotation speed of the developing sleeve 28, the developer quantity returned to the supply chamber 23 due to the rotation of the conveying screws 25, 26 is decreased while the developer quantity conveyed to the retrieval chamber 24 due to the rotation of the developing sleeve 28 remains the same. As a result, the developer quantity in the supply chamber 23 is to be decreased. When the developer quantity in the supply chamber 23 is decreased, the developer quantity supplied to the developing sleeve 28 is decreased, so that the quantity of the developer layer accumulated at the next upper part of the restriction blade 30 can be decreased.

Based on the above theory, in order to decrease the developer quantity of the supply chamber 23, it is understood that Vsc/Vsl is changed to be small. Here, Vsc denotes the rotation speed of the conveying screws 25, 26 and Vsl denotes the rotation speed of the developing sleeve 28. When Vsc/Vsl becomes small, the conveying quantity of developer to the supply chamber 23 due to the conveying screws 25, 26 is relatively decreased. As a result, the quantity of the developer layer accumulated at the next upstream part of the restriction blade 30 can be decreased.

Here, Vsc/Vsl can be lessened by either way of decreasing the rotation speed of the conveying screws 25, 26 and increasing the rotation speed of the developing sleeve 28. The effect can be obtained by either way. When Vsc/Vsl is lessened by decreasing the rotation speed of the conveying screws 25, 26, the developer supplying quantity to the developing sleeve 28 is decreased due to decrease in the developer quantity. In addition, since the developer quantity supplied to the developing sleeve 28 by the rotation of the conveying screw 25 is decreased, the developer quantity of the developer layer at the next upstream part of the restriction blade 30 can be effectively decreased. Accordingly, in the present embodiment, Vsd/Vsl is lessened by decreasing the rotation speed of the conveying screws 25, 26 in order to decrease developer quantity at the next upstream part of the restriction blade 30.

Here, as illustrated in FIG. 1, the image forming apparatus includes a CPU 50 as a controller to control each part within the apparatus. The CPU 50 is capable of performing a mode to change the rotation speed of the conveying screws 25, 26 (or the rotation speed of the developing sleeve 28). In the present embodiment, the CPU 50 controls a conveying screw drive motor 51 (see FIG. 7A) to drive the conveying screws 25, 26 so as to decrease the rotation speed of the conveying screws 25, 26. That is, during the abovementioned mode, the CPU 50 controls the rotation speed of the conveying screws 25, 26 to be lower than that during image forming. Here, the controller is included in the image forming apparatus. However, not limited to the above, it is also possible that the controller is included in the development apparatus 4 and that the controller is utilized.

In order to achieve the above operation, a separate drive motor (not illustrated) is arranged respectively for the developing sleeve 28 and the conveying screws 25, 26. With this configuration, the developing sleeve 28 and the conveying screws 25, 26 can be controlled independently from one another.

In the present embodiment, since the first conveying screw 25 and the second conveying screw 26 are driven by a single drive motor, the speed of the conveying screws 25, 26 is decreased simultaneously. Here, in the case that both of the conveying screws 25, 26 are capable of being independently driven, the developer quantity balance between the supply chamber 23 and the retrieval chamber 24 can be changed by respectively varying the rotation speed thereof. Accordingly, the developer quantity in the supply chamber 23 can be further decreased. In general, in a part where conveying screw speed is slow, developer is apt to be stagnant and developer quantity is apt to be increased. On the contrary, in a part where conveying screw speed is fast, the developer quantity is apt to be decreased. Accordingly, in order to decrease the developer quantity in the supply chamber 23 and increase the developer quantity in the retrieval chamber 24, it is preferable that the speed of the first conveying screw 25 is to be relatively higher than that of the second conveying screw 26.

Then, for lessening Vsc/Vsl by decreasing the rotation speed of the conveying screws 25, 26 with the above operation, when Vsc25/Vsc26 is controlled to be large as the rotation speed of the second conveying screw 26 is changed to be smaller, the developer quantity in the supply chamber 23 can be further decreased so as to enhance efficiency. Here, Vsc25 and Vsc26 respectively denote the rotation speed of the first conveying screw 25 and the second conveying screw 26. That is, the CPU 50 controls the rotation speed of the second conveying screw 26 to be lower than that of the first conveying screw 25 during the above-mentioned mode.

Next, the timing to perform the above operation will be described. The operation to lessen Vsc/Vsl is performed to eliminate the toner layer growing during image forming by moving the boundary surface between the developer non-flowing layer and the developer flowing layer. The operation to lessen Vsc/Vsl to be smaller than that during image forming may be performed when image forming is not performed (for example, during previous-rotation or after-rotation of image forming) while normal operation is performed during image forming. With the above operation, the toner layer formed between the developer flowing layer and the developer non-flowing layer which are formed during image forming can be regularly eliminated. In this manner, since the toner layer is eliminated before the toner layer grows and disturbs conveying of developer to the developing area, the thickness of developer to be conveyed to the developing area can be stably maintained for the long term.

Figure 7B:
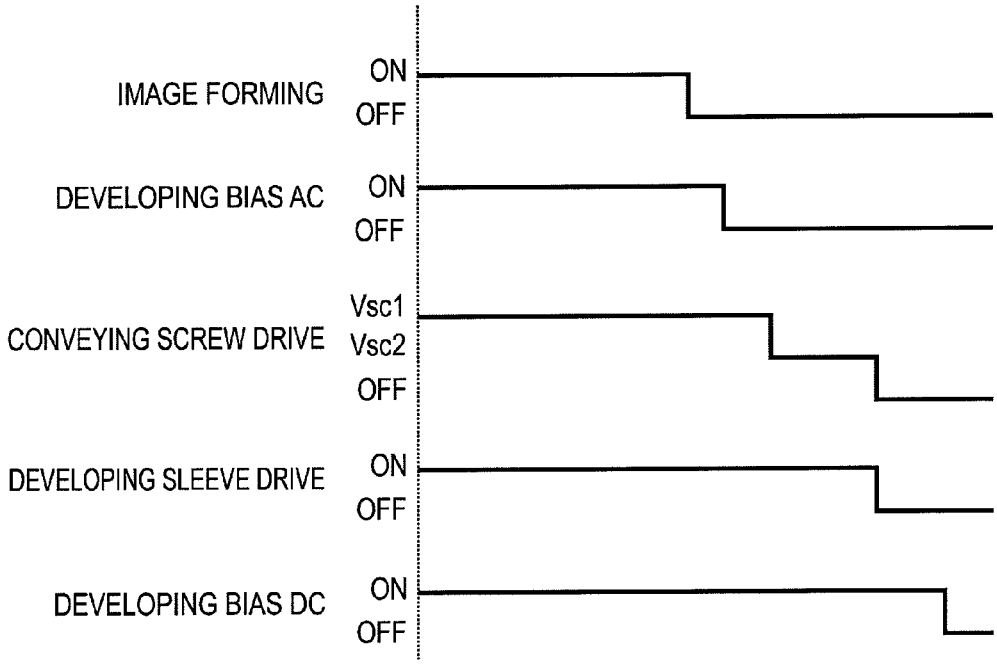
FIG. 7B is a timing chart of the first embodiment.
Figure 8:
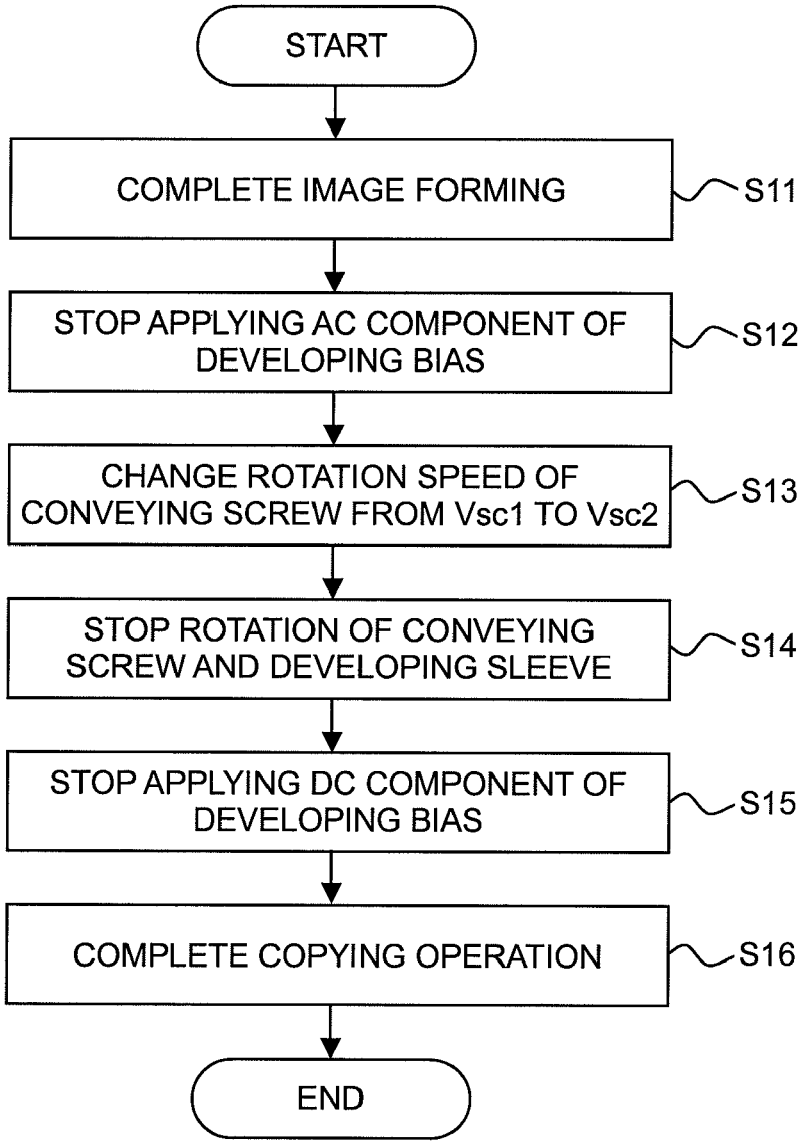
FIG. 8 is a flowchart which describes flow of operation to move the boundary surface between the developer flowing layer and the developer non-flowing layer of the first embodiment in the direction being apart from a circumferential surface of the developing sleeve.

The present embodiment adopts operation to lessen Vsc/Vsl during the after-rotation of image forming (i.e., when image forming is not performed) from that during image forming. Similar effects can be obtained by performing either during previous rotation or after rotation. However, in the case of being performed during previous-rotation, there may be a risk that the time from copy starting until the first sheet is discharged (i.e., so-called FCOT or FPOT) is prolonged. Therefore, it is performed during after-rotation in the present embodiment. Here, the previous-rotation of image forming refers to operation such as control performed from copy starting until image forming is started (i.e., denotes all operations when performed in plural). Meanwhile, the after-rotation of image forming refers to operation performed after image forming completion until copying operation ends. The above operation will be described with reference to a timing chart of FIG. 7B and a flowchart of FIG. 8. As illustrated in FIGS. 7B and 8, the CPU 50 as the controller stops applying an AC component of development bias (S12) after image forming is completed (S11). Thereafter, the rotation speed of the conveying screws 25, 26 is changed to the rotation speed Vsc2 being lower than the rotation speed Vsc1 during image forming (S13).

Figure 7A:
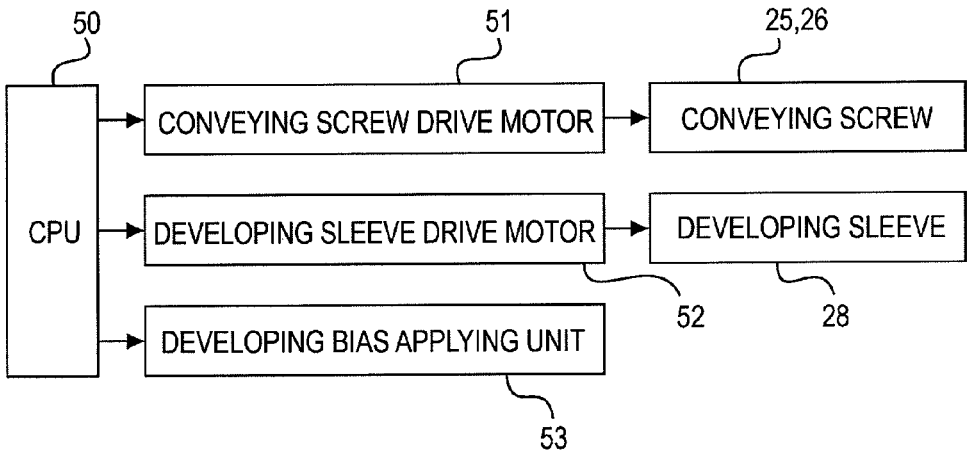
FIG. 7A is a block diagram of controlling the development apparatus.

The CPU 50 as the controller controls the conveying screw drive motor 51 as a drive source to drive the conveying screws 25, 26 so that the rotation speed of the conveying screws 25, 26 is lowered, as illustrated in FIG. 7A. Further, the CPU 50 controls a developing sleeve drive motor 52 as a drive source to drive the developing sleeve 28, so that the rotation speed of the developing sleeve 28 is changed. In addition, the CPU 50 controls a developing bias applying unit 53 which applies the developing bias (i.e., an AC component and a DC component).

At the time of changing the rotation speed of the conveying screws 25, 26 as described above, since the developing sleeve 28 is maintained as being rotated, the developer quantity at the next upstream part of the restriction blade 30 is gradually decreased. Being accompanied therewith, the boundary surface between the developer flowing layer and the developer non-flowing layer is moved in the direction being apart from the sleeve surface. The toner layer formed at the boundary surface by that time is to be in the flowing layer and is moved as passing the restriction blade 30. At the timing when the boundary surface is sufficiently moved, the rotation of the conveying screws 25, 26 and the developing sleeve 28 is stopped (S14). Lastly, applying of the DC component of the developing bias is stopped (S15) and the copying operation is completed (S16).

Here, the timing during image forming is not performed is not limited to the above-mentioned previous-rotation and after-rotation of image forming. For example, in the case of rapid growing of the toner layer formed at the boundary surface between the developer non-flowing layer and the developer flowing layer, the operation to lessen Vsc/Vsl may interrupt as arranging a down-sequence at some midpoint of the image forming operation.

Endurance evaluation was actually performed as performing the operation to change the ratio between the rotation speed Vsc of the conveying screws 25, 26 and the rotation speed Vsl of the developing sleeve 28 at the after-rotation of image forming, so that occurrence of decrease in developer conveying quantity due to toner layer forming was observed. The rotation speed Vsc of the conveying screws 25, 26 and the rotation speed Vsl of the developing sleeve 28 during image forming are respectively set at 400 rpm and 300 rpm. Meanwhile, the observation was performed in the cases that the rotation speed Vsc of the conveying screws 25, 26 during image forming is not performed (i.e., during the after-rotation of image forming) is set to be 200 rpm (i.e., Example 1) and to be 0 rpm (i.e., to be stopped; Example 2). Further, as comparative examples, the observation was performed in the cases that the rotation speed Vsc of the conveying screws 25, 26 was not changed (i.e., Comparative example 1) and was increased to 500 rpm (i.e., Comparative example 2).

The evaluation was performed intermittently for every 500 sheets. The operation to change Vsc/Vsl was performed during the after-rotation for every 500 sheets. The observation was performed to check occurrence of decrease in developer conveying quantity due to toner layer forming at the time of usage of 10000 sheets. Further, the time until the boundary surface was sufficiently moved with the operation to lessen Vsc/Vsl was observed as well.

The result of the above evaluation is indicated in Table 1. When the operation to lessen Vsc/Vsl during image forming was not performed (i.e., during the after-rotation) from that during image forming as Examples 1 and 2, decrease in developer conveying quantity due to toner layer forming did not occur. On the other hand, in the case that Vsc/Vsl was not changed as comparative example 1 and the case that the operation to enlarge Vsc/Vsl was performed as comparative example 2, decrease in developer conveying quantity occurred due to toner layer forming. Thus, it is understood that the operation to lessen Vsc/Vsl is effective against occurrence of decrease in developer conveying quantity due to toner layer forming.

TABLE 1

| | During image forming | Example 1 | Example 2 | Comparative example 1 | Comparative example 2 |
|---|---|---|---|---|---|
| Vsc | 400 rpm | 200 rpm | 0 rpm | 400 rpm | 500 rpm |
| Vsl | 300 rpm | 300 rpm | 300 rpm | 300 rpm | 300 rpm |
| Vsc/Vsl | 1.33 | 0.67 | 0 | 1.33 | 1.66 |
| Conveying quantity decrease occurrence | — | Not-observed | Not-observed | Observed | Observed |
| Required time for boundary surface movement | — | 3 sec | 1 sec | — | — |

In the above evaluation, the time until the boundary surface was sufficiently moved with the operation to lessen Vsc/Vsl was observed as well. Specifically, the observed time is the time from the instant at which the operation to lessen Vsc/Vsl is performed on the conveying screws 25, 26 until the toner layer is conveyed to the developing sleeve 28 as passing the restriction blade 30. As a result, it is understood that the time until the toner layer formed at the boundary surface is moved and passes the restriction blade 30 is shorter as Vsc/Vsl becomes smaller.

According to the above, it is understood that regularly performing the operation to lessen Vsc/Vsl is sufficiently effective for occurrence of decrease in developer conveying quantity due to toner layer growing and that movement of the boundary surface is completed in shorter time as Vsc/Vsl is smaller. It is preferable of being with the shorter time until the boundary surface is moved, because of an advantage that the operation time during image forming is not performed can be shortened.

Figure 9A:
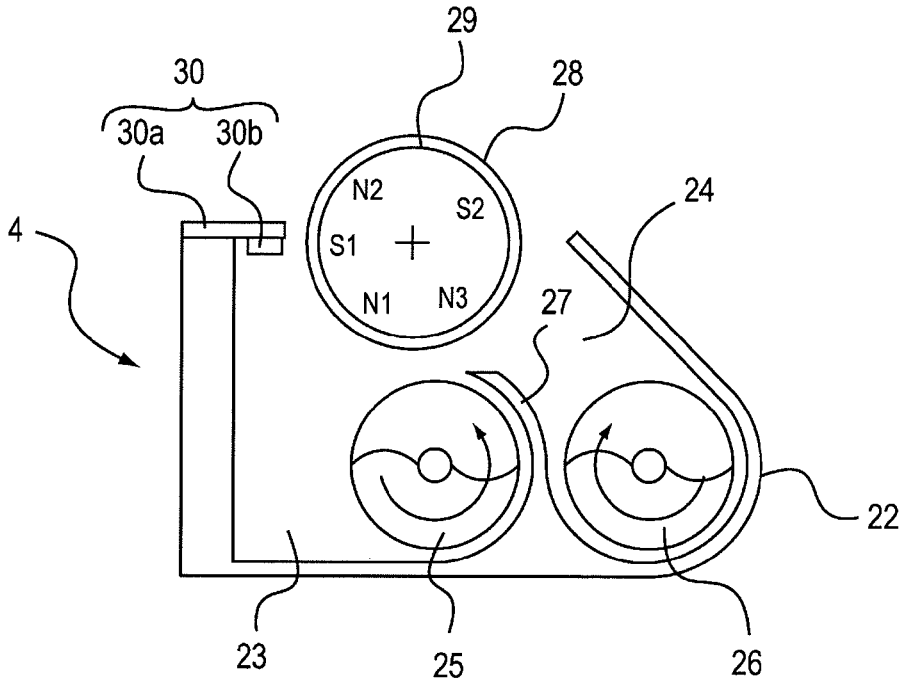
FIGS. 9A and 9B are explanatory views which illustrate other examples of the development apparatus of the first embodiment.

In the present embodiment, the development apparatus is configured to have a developer container 22 having the supply chamber 23 and the retrieval chamber 24 arranged one above the other, as an example. However, not limited to this, the present invention can be adopted to a development apparatus having the supply chamber 23 and the retrieval chamber 24 arranged horizontally or a development apparatus of other configuration, for example. FIG. 9A illustrates an example of the development apparatus having the supply chamber 23 and the retrieval chamber 24 arranged horizontally. The example is configured to separately arrange the supply chamber 23 and the retrieval chamber 24 respectively for supplying to the developing sleeve 28 and for retrieving from the developing sleeve 28. It is more preferable that supplying to the developing sleeve 28 and retrieving from the developing sleeve 28 are performed by the structure having the supply chamber 23 and the retrieval chamber 24 separated. However, even when supplying to the developing sleeve 28 and retrieving from the developing sleeve 28 are performed only by one chamber, the effects can be obtained.

Figure 9B:
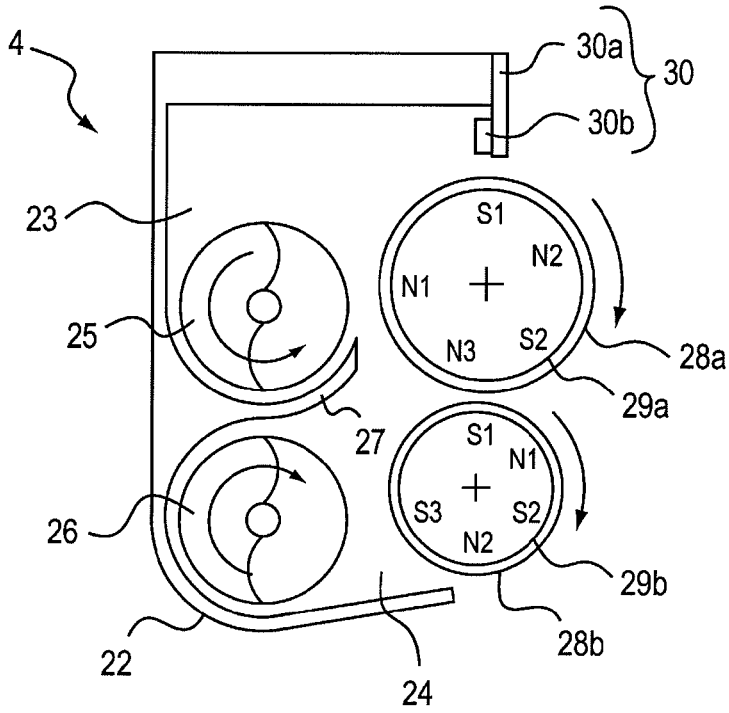

Further, the present embodiment is described with the case of the single developing sleeve 28. However, as illustrated in FIG. 9B, the present invention can be adopted to the case of having two or more developing sleeves 28. In this case, provided that the supply chamber 23 and the retrieval chamber 24 are separately arranged, the effects of the present invention can be obtained.

Regarding the restriction blade configuration, in the above description, the restriction blade 30 is exemplified as the structure combining the nonmagnetic member 30*a* and the magnetic member 30*b*. Similar theory can be applied to the other configurations and the effects can be obtained. For example, the restriction blade may be formed only of a magnetic member (i.e., a magnetic plate) or may be formed only of a nonmagnetic member (i.e., a nonmagnetic plate).

The repose angle $\phi$ of developer is included actually in the equation as the internal friction angle $\phi$ when acquiring the shearing strength s in view of the friction coefficient within developer. According to the study of the inventor, the repose angle $\phi$ is required to be in a range from 20° to 70°. Preferably, the repose angle $\phi$ is set to be in a range from 30° to 60°, and more preferably, in a range from 35° to 50°.

When the value of the repose angle $\phi$ is smaller than the above range, tan $\phi$ becomes small and the restriction force fb by the restriction blade 30 constitutes main part of the force constituting the shearing strength $s=(W+fm)\tan\phi+fb$. In this case, there arises a problem that the effect by reducing the developer weight W is to be unclear. On the other hand, when the value of the repose angle $\phi$ is larger than the above range, developer flowability is to be too low. In this case, there arise problems that developer ability is insufficient and that agitation ability of supplemental toner is to be worsened needless to discuss the problem to be solved by the present invention.

Figure 10:
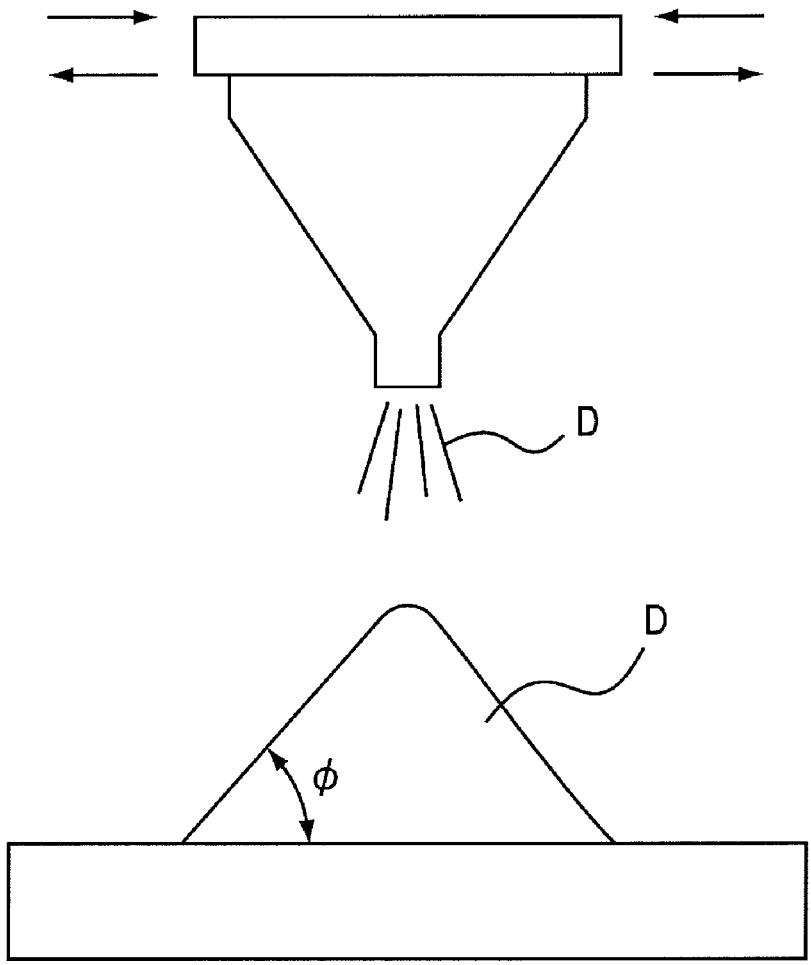
FIG. 10 is an explanatory view of a measuring method of a repose angle.

Here, the repose angle of developer is defined by the angle of a mountain formed at the lower part when developer D is fallen from the upper part as illustrated in FIG. 10, that is, the angle $\phi$ in FIG. 10. The developer D is not to be slid down due to own weight having in the condition being equal to or smaller than the angle $\phi$.

Measurement of the repose angle can be performed with a following method, for example. A sieve of 246 μm is set on a vibration base of a powder tester (PT-N type, manufactured by HOSOKAWA MICRON CORPORATION). Vibration is applied for 180 seconds as a test sample of 250 cc is accommodated therein. The repose angle of the toner on the table for repose angle measurement is measured with an angle measurement arm.

Second Embodiment

The second embodiment is different from the abovementioned first embodiment by the following described points. The rest of the points is configured to be similar to the first embodiment. Accordingly, in the description of the second embodiment, the same numeral is given to the same structural element corresponding to the structural element of the first embodiment and the detailed description will not be repeated.

In the first embodiment, the boundary surface between the flowing layer and the non-flowing layer determined by the shearing strength s and the shearing stress t is moved by lessening the shearing strength s. Here, when the shearing stress t is changed in addition to changing the shearing strength s, the movement of the boundary surface can be performed more effectively. In order to move the boundary surface between the flowing layer and the non-flowing layer in the direction being apart from the circumferential surface of the developing sleeve 28, the shearing stress t is required to be enlarged being in an opposite manner to lessen the shearing strength s. Since the shearing stress t is basically constituted with propulsive force fs due to rotation of developing sleeve 28, it is only required to enlarge the propulsive force fs from the developing sleeve 28.

The propulsive force fs can be enlarged by increasing the rotation speed of the developing sleeve 28. With this operation, the boundary between the developer flowing layer and the developer non-flowing layer can be moved.

Here, as illustrated in FIG. 1, the image forming apparatus includes the CPU 50 as the controller to control each part within the apparatus. The CPU 50 is capable of controlling to drive the developing sleeve 28. In the present embodiment, the CPU 50 controls the developing sleeve drive motor 52 (see FIG. 7A) as the drive source to drive the developing sleeve 28 so that the rotation speed of the developing sleeve 28 is driven to be higher than that during image forming. That is, during the abovementioned mode, the CPU 50 controls the rotation speed of the developing sleeve 28 to be higher than that during image forming. Here, the controller is included in the image forming apparatus. However, not limited to the above, it is also possible that the controller is included in the development apparatus 4 and that the controller is utilized.

With the method for increasing the rotation speed of the developing sleeve 28, Vsc/Vsl described in the first embodiment becomes small as well, the developer quantity in the supply chamber 23 is decreased and the developer weight of the developer layer at the next upstream side of the restriction blade 30 is also decreased. Accordingly, the effect to lessen the shearing strength s can be obtained at the same time in addition to the effect to enlarge the shearing stress t, so that the boundary between the developer flowing layer and the developer non-flowing layer can be moved efficiently.

Figure 11A:
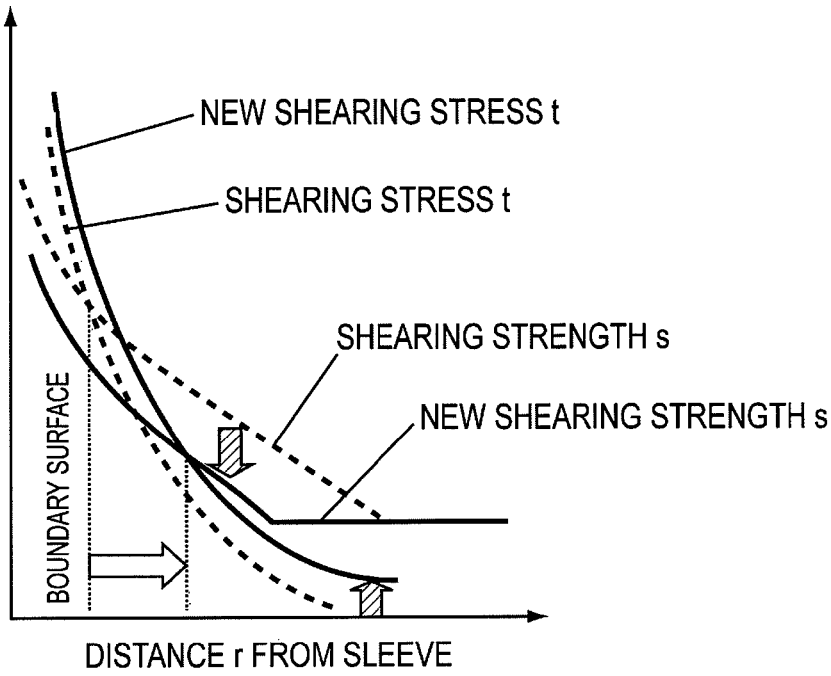
FIGS. 11A and 11B are explanatory views for movement of the boundary surface according to the second embodiment.

Therefore, in the case of moving the boundary surface between the flowing layer and the non-flowing layer during image forming is not performed, the present embodiment is configured to increase the rotation speed of the developing sleeve 28 simultaneously with decreasing the rotation speed of the conveying screws 25, 26. Accordingly, as illustrated in FIG. 11A, the boundary surface can be largely changed by additionally moving the shearing stress t compared to the case that only the shearing strength s is moved.

In the present embodiment, the rotation speed Vsl of the developing sleeve 28 is set at 300 rpm and the rotation speed Vsc of the conveying screws 25, 26 is set at 400 rpm during image forming (i.e., Vsc/Vsl=1.33). Meanwhile, when moving the boundary surface between the flowing layer and the non-flowing layer when image forming is not performed, the rotation speed Vsc of the conveying screws 25, 26 is set at 200 rpm and the rotation speed Vsl of the developing sleeve 28 is set at 450 rpm. That is, Vsc/Vsl=0.44. As a result of the inventor's evaluation of intermittent usage for every 500 sheets with the above configuration as similar to the first embodiment, decrease in developer conveying quantity due to disturbance by the tone layer did not occur. Further, the time until the toner layer at the boundary surface was moved was 2 seconds, which is shorter than the time when only the rotation speed of the conveying screws 25, 26 was changed as Example 1 of the first embodiment.

In the case that the rotation speed of the developing sleeve 28 is increased, higher effects can be obtained with higher speed. However, in view of load or in view of splash due to rotation speed increase, the rotation speed cannot be actually increased that much. It is preferable that the rotation speed is increased with a limitation of being twice higher than that during image forming. It is more preferable to limit by 1.5 times. The present embodiment adopts 1.5 times limitation.

Figure 11B:
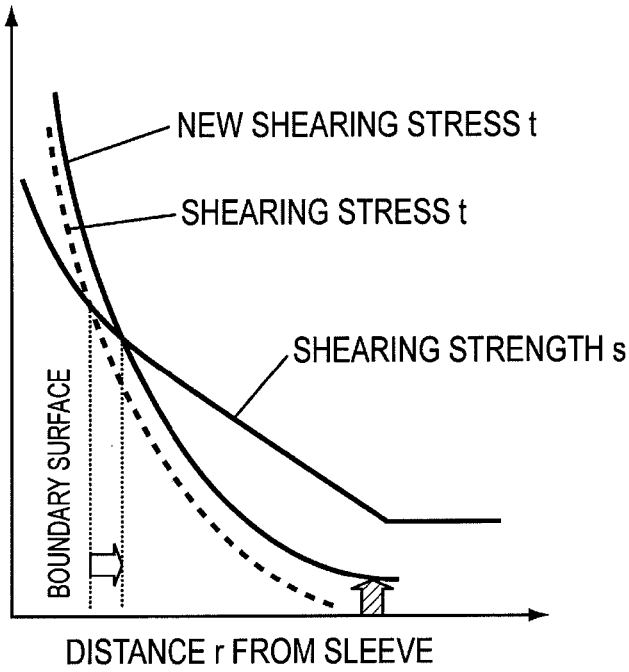
Figure 12:
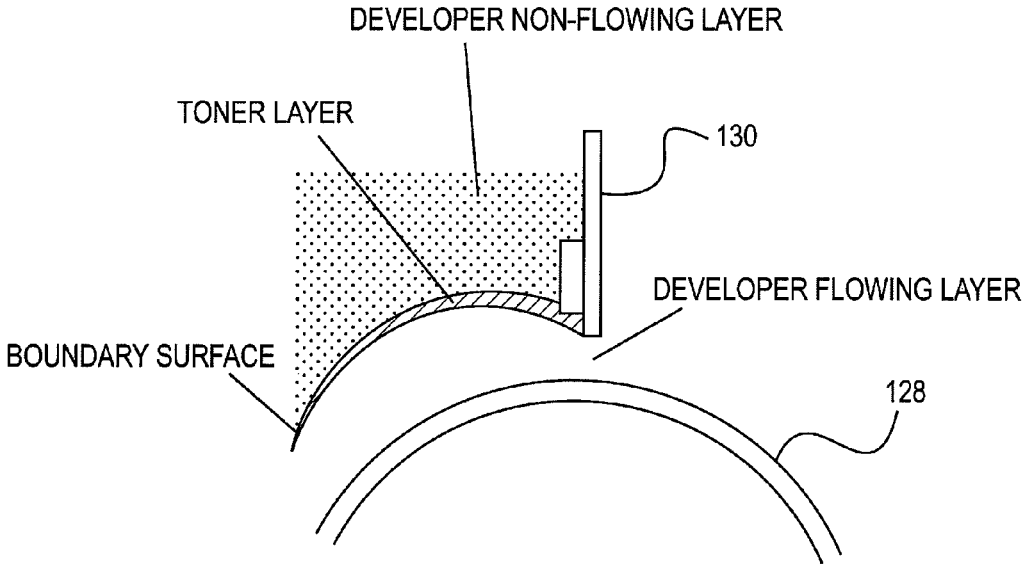
FIG. 12 PRIOR ART
FIG. 12 is a sectional view which schematically illustrates a state of performing thickness restriction of developer on the surface of the developing sleeve by a restriction blade in the development apparatus of the related art.

The present embodiment exemplifies the configuration to simultaneously change the shearing strength s and the shearing stress t in order to move the boundary surface in the direction being apart from the sleeve surface. However, not limited to this, it is also possible to change only the shearing stress t without changing the shearing strength s. Here, the reason why the present embodiment simultaneously changes the shearing strength s and the shearing stress t for moving the boundary surface is as follows. The shearing stress t varies nonlinearly against the distance r from the developing sleeve 28. Accordingly, as illustrated in FIG. 11B, there may be a case that the effect of moving the boundary surface does not appear well depending on a position. Meanwhile, the developer weight W as a structural element of the shearing strength s varies linearly against the distance r from the developing sleeve 28. Accordingly, the effect of moving the boundary surface can be obtained being likely regardless of a position such as the distance from the developing sleeve 28. Therefore, the present embodiment adopts the configuration to obtain larger variation of the boundary surface by changing the shearing stress t in addition to changing the shearing strength s.

As described above, according to the present embodiment, the effects similar to the above-mentioned first embodiment can be obtained as well. Further, according to the present embodiment, compared to the abovementioned first embodiment, movement can be performed more largely and more rapidly when the boundary surface is to be moved in the direction being apart from the sleeve surface. Accordingly, since the toner layer is eliminated before the toner layer grows and disturbs conveying of developer to the developing area, the thickness of developer to be conveyed to the developing area can be stably maintained for the long term as well.

Here, the above embodiments adopt four image forming portions. However, not limited to the above, the number for usage may be appropriately set as necessary.

Further, in the above embodiments, a printer is exemplified as the image forming apparatus. However, the present invention is not limited to this. The image forming apparatus may be an image forming apparatus such as a copying machine, a facsimile machine or a multiple function machine having the above functions combined. Further, the exemplified image forming apparatus utilizes the intermediate transfer member to which toner images of respective colors are sequentially superimposed and the toner image borne on the intermediate transfer member is transferred to a recording medium by one operation. However, not limited to this, it is also possible to adopt an image forming apparatus utilizing a recording medium bearing member and toner images of respective colors are transferred to the recording medium borne at the recording medium bearing member as being sequentially superimposed. The similar effects can be obtained by applying the present invention to a development apparatus utilized for the above image forming apparatuses.

According to the present invention, the operation to move a toner layer formed at a boundary surface between a developer flowing layer and a developer non-flowing layer at the next upstream part of a thickness restriction member in the direction being apart from a developer bearing member is performed regularly (i.e., during image forming is not performed). With this configuration, the toner layer can be eliminated from the next upstream part of the thickness restriction member before the toner layer grows and the thickness of developer conveyed to a developing area can be stably maintained for the long term.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2009-202405, filed Sep. 2, 2009, which is hereby incorporated by reference herein in its entirety.

What is claimed is:

1. A development apparatus comprising:

a developer bearing member which bears and conveys developer;

a thickness restriction member which restricts developer quantity at the developer bearing member;

a first chamber which can accommodate developer which is to be to supplied to the developer bearing member, wherein the first chamber comprises an opening portion to which a part of the developer bearing member is exposed;

a second chamber which forms a circulation passage along with the first chamber and which retrieves developer used for development at the developer bearing member;

a conveying member which conveys developer in the circulation passage formed by the first chamber and the second chamber; and a controller which is capable of controlling rotation speed of the conveying member and rotation speed of the developer bearing member so that a ratio Vsc/Vsl in a first mode is less than a ratio Vsc/Vsl in a second mode, wherein Vsc denotes the rotation speed of the conveying member and Vsl denotes the rotation speed of the developer bearing member.

2. The development apparatus according to claim 1, wherein the first mode is a mode in which image forming is not performed and wherein the second mode is a mode in which image forming is performed.

3. The development apparatus according to claim 1, wherein the first mode is a mode in which image forming is not performed and wherein the second mode is a mode in which image forming is performed; and wherein the controller controls the rotation speed of the conveying member such that the rotation speed of the conveying member is lower when image forming is not performed in the first mode than that when image forming is performed in the second mode.

4. The development apparatus according to claim 1, wherein the first mode is a mode in which image forming is not performed and wherein the second mode is a mode in which image forming is performed; and wherein the controller controls the rotation speed of the developer bearing member so as to be higher when image forming is not performed in the first mode than that when image forming is performed in the second mode.

5. The development apparatus according to claim 1, wherein, in the first mode, the controller is configured to increase the rotation speed of the developing bearing member while simultaneously decreasing the rotation speed of the conveying member.

6. The development apparatus according to claim 1, wherein the first mode is a mode in which image forming is not performed and wherein the second mode is a mode in which image forming is performed;

wherein the conveying member includes a first conveying member to convey developer in the first chamber and a second conveying member to convey developer in the second chamber, and wherein the controller controls rotation speed of the second conveying member in relation to a rotation speed of the first conveying member such that the rotation speed of the second conveying member is lower than the rotation speed of the first conveying member when image forming is not performed compared to when image forming is performed.

* * * * *